US005567173A

United States Patent [19]

Franckx

[11] Patent Number: 5,567,173

[45] Date of Patent: Oct. 22, 1996

[54] ELECTRICAL CONNECTOR

[75] Inventor: Joris I. Franckx, Bonheiden, Belgium

[73] Assignee: N.V. Raychem S.A., Kessello, Belgium

[21] Appl. No.: 244,011

[22] PCT Filed: Nov. 9, 1992

[86] PCT No.: PCT/GB92/02063

§ 371 Date: May 12, 1994

§ 102(e) Date: May 12, 1994

[87] PCT Pub. No.: WO93/10575

PCT Pub. Date: May 27, 1993

[30] Foreign Application Priority Data

Nov. 14, 1991 [GB] United Kingdom ..... 9124180

[51] Int. Cl.[6] ..... H01R 4/24

[52] U.S. Cl. ..... 439/418; 439/403; 439/404

[58] Field of Search ..... 29/739, 758; 439/695, 439/696, 701, 217, 218, 220, 221, 166, 170, 171, 173, 174, 395–404, 403, 418

[56] References Cited

U.S. PATENT DOCUMENTS

| | | | |
|---|---|---|---|
| 3,611,268 | 10/1971 | Webb | 439/894 |
| 3,945,705 | 3/1976 | Seim et al. | 439/403 |
| 4,047,784 | 9/1977 | Trank | 439/403 |
| 4,193,201 | 3/1980 | Van Horn | 439/403 |
| 4,436,359 | 3/1984 | Kasper et al. | 439/346 |
| 4,552,429 | 11/1985 | van Alst | 439/403 |
| 4,764,125 | 8/1988 | Debortoli | 439/403 |
| 5,281,163 | 1/1994 | Knox et al. | 439/410 |

FOREIGN PATENT DOCUMENTS

| | | |
|---|---|---|
| 1277736 | 12/1990 | Canada . |
| 2115992 | 9/1983 | United Kingdom . |
| 2173650 | 10/1986 | United Kingdom . |

*Primary Examiner*—David L. Pirlot
*Attorney, Agent, or Firm*—William D. Zahrt, II; Herbert G. Burkard

[57] ABSTRACT

A connector for interconnecting first and second electrical conductors, comprising (a) a first part;

(b) a second part; the first and/or second parts forming a housing;

(c) a first contact attached to the first part and capable of making contact with the first conductor; and (d) a second contact temporarily attached to the first part and capable of making contact with the second conductor; the second part having means for receiving the second contact when the first and second parts are brought together such that the second contact remains thus received on subsequent separation of the first and second parts.

15 Claims, 14 Drawing Sheets

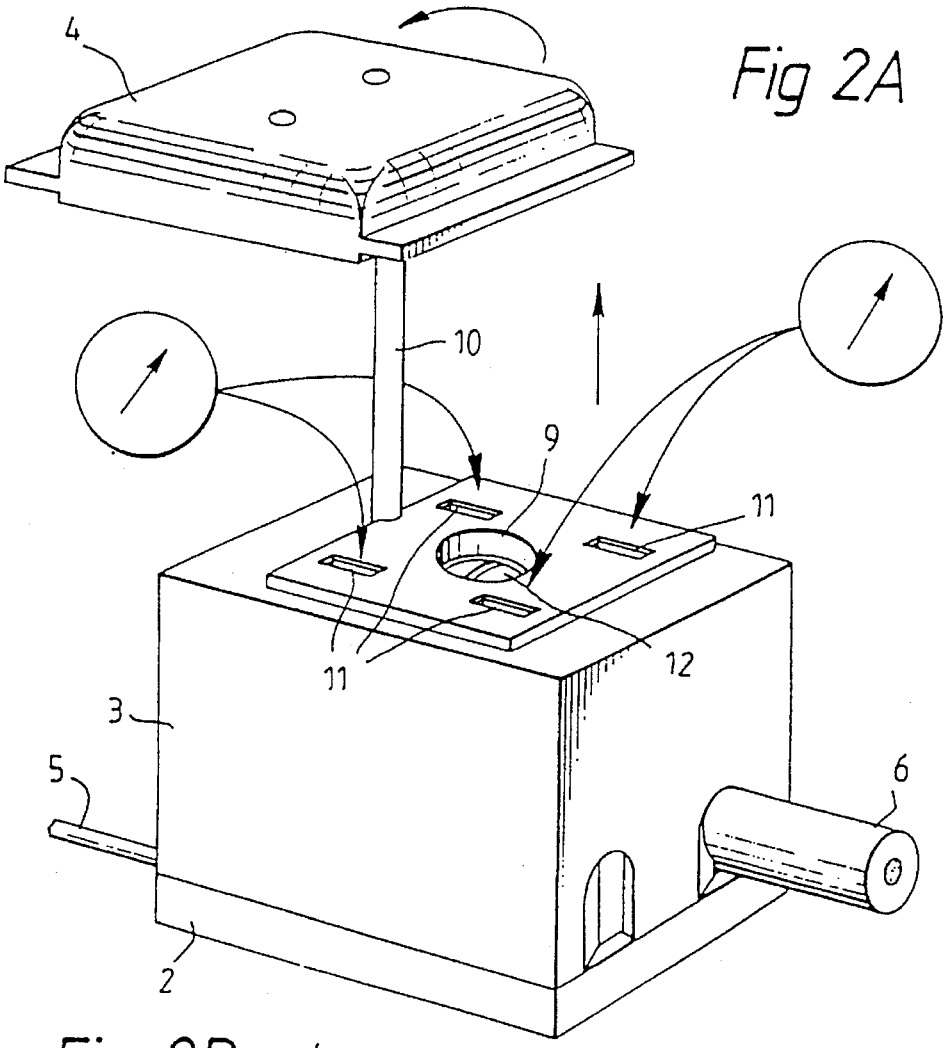
Fig 2A
Fig 2B
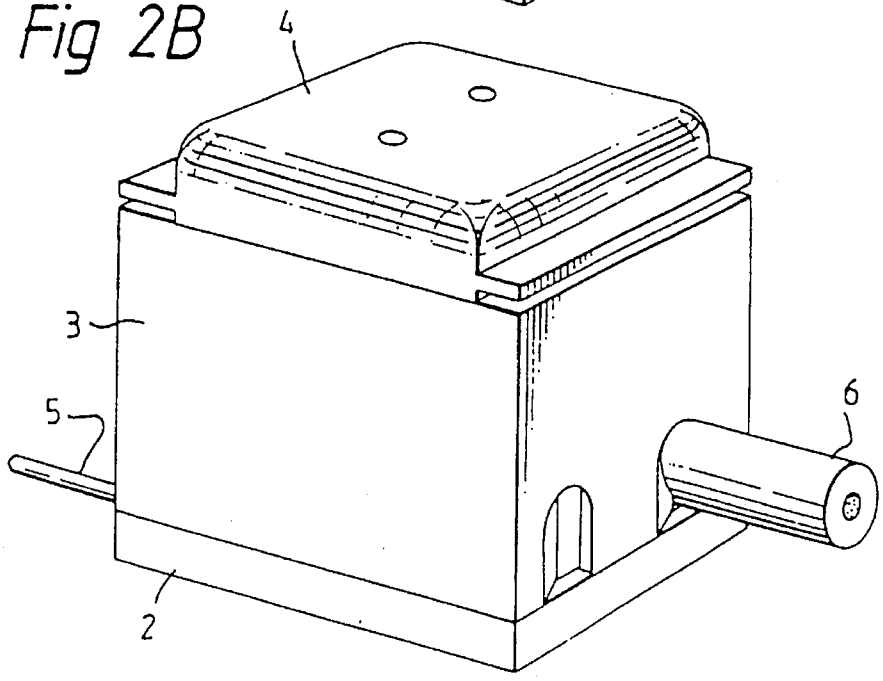

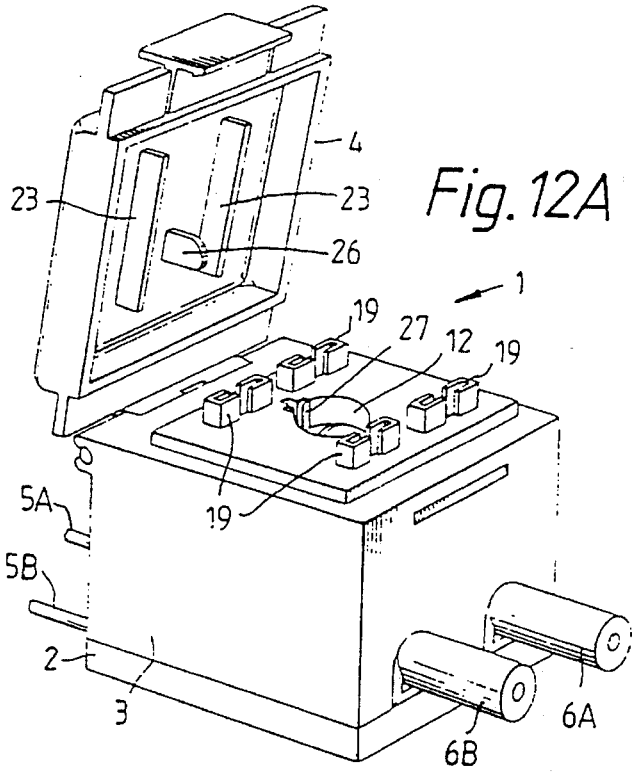
Fig. 12A
Fig. 12C
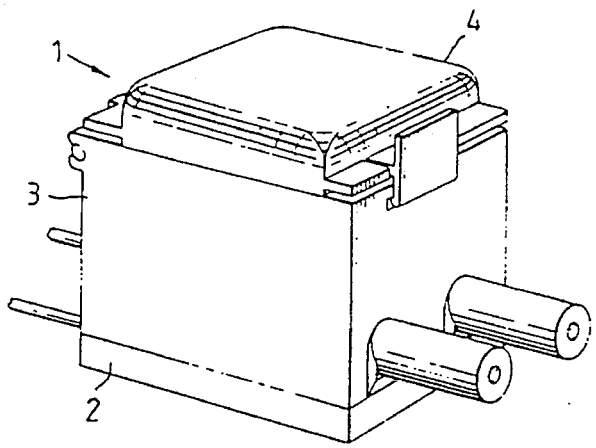
Fig. 12B
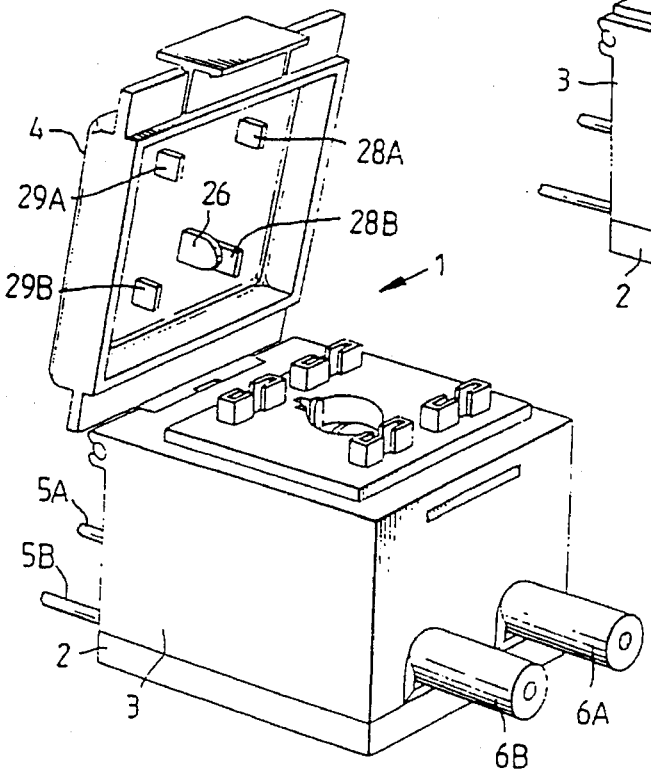

ELECTRICAL CONNECTOR

The present invention relates to an electrical connector, in particular one suitable for use in a telecommunications system, particularly at a distribution point in a telephone network.

Such connectors are necessary to connect wires from a distribution cable from a central office to drop wires leading to a subscriber's telephone or other equipment. Connections can be made between the main wires to the central office and the drop wires in a more or less permanent manner by means of a so-called B-wire connector or other crimp or solder connection. This, however, has the disadvantage that rearrangement of the network connections cannot easily be made, and various specialized features cannot easily be provided at the distribution point. Such other features include electrical protection against, for example, mains cross and lightening, and remote disconnect and testing.

Terminal blocks have been designed to overcome these problems, but they have tended to be large, complex and expensive. Also most blocks are for a fixed number of pairs of wires, and this has the disadvantage that a complete terminal block has to be purchased even if only a few pairs are initially to be connected. Also, repair of a partially damaged prior art block is in general impossible.

A selection of prior art designs where these problems are minimized is as follows: U.S. Pat. Nos. 3,496,522, 3,708,779, 3,836,944, 49,344,664, 3,971,615, 3,971,616, 4,047,784, 4,435,034, 4,444,447, 4,449,777, 4,580,864, 4,652,070, 4,741,480, 4,764,125, 4,767,354, 4,836,800, 4,954,098, 4,988,311, 4,993,966, UK patents 2047984, 2129628, 2129630, 2176062, 2215532, 2196492, and FR 622058 and CA 1176330. The disclosure of each of these patents is incorporated herein by reference.

In spite of these various designs, problems remain in producing a simple connector that is easy to make and to use and that can provide features such as environmental and/or electrical protection, modular design, suitable wire gauge range, allowing line testing, re-usability, disconnection etc.

We have now designed an electrical connector that can provide these features.

Thus, the invention provides a connector for interconnecting first and second electrical conductors, comprising (a) a first part;

(b) a second part; the first and/or second parts forming a housing;

(c) a first contact attached to the first part and capable of making contact with the first conductor; and (d) a second contact temporarily attached to the first part and capable of making contact with the second conductor;

the second part having means for receiving the second contact when the first and second parts are brought together such that the second contact remains thus received on subsequent separation of the first and second parts.

The invention also provides a connector for interconnecting two pairs of conductors, which comprises first and second parts having four independent electrical contacts such that when the first and second parts are brought together an electrical connection is made between each contacts and a respective conductor, the connector having externally-accessible surface at which electrical connection can be made to each of the four contacts.

The invention further provides a connector comprising a first part that has externally-accessible contacts, each of which being individually connectable to a conductor to be connected by the connector, and a second part that can interconnect the contacts, the second part being separable from the first part by translational motion, and subsequently by rotation.

The invention is further illustrated by the accompanying drawings in which:

FIGS. 2A and 2B show an alternative design of connector;

FIGS. 12 and 13 show use of modular connectors; and

Figure 1:
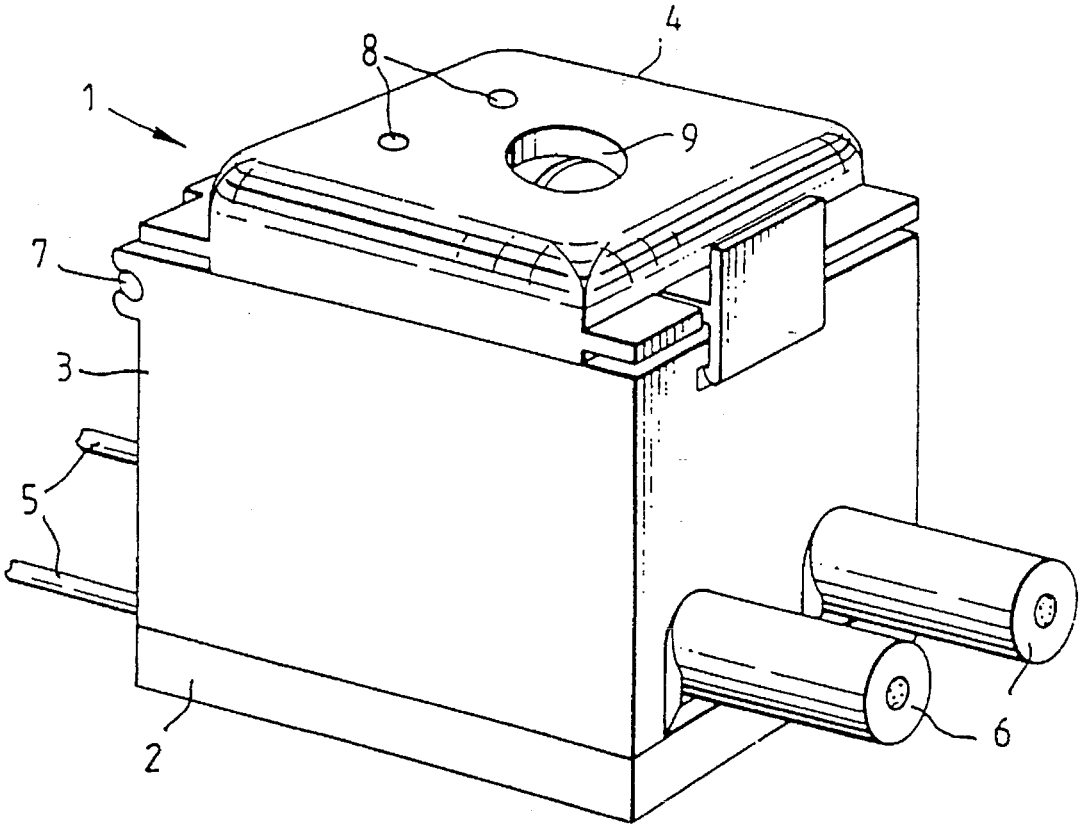
FIG. 1 shows a modular connector.

FIG. 1 shows a modular connector suitable for connecting together two pairs of wires. A similar connector could be made for interconnecting one, three or other number of pairs of wires. The connector is particularly useful for use in a telecommunications system, especially at a distribution or other point in a telephone network. Several, for example 3, 5, 10, 20, 25 or 50 such connectors may be used together in a single housing.

The connector 1 comprises a first part 2 such as a base, a second part 3 and a third part 4 such as a cover or lid. It serves to interconnect two conductors 5 to two conductors 6. The conductors may be, for example, a pair of telecommunications wires from a central office, and conductors 6 may be, for example a pair of drop wires to a subscriber's telephone or other equipment.

The cover 4, which may be connected to the second part 3 by means of a hinge 7, may have means such as holes 8 allowing conductors within the connector to be tested. Such testing may be carried out simply by inserting a probe through the holes. The large central hole 9 may serve to house a bolt or other device for bringing together or maintaining together, two or more of the parts of the connector. Such a bolt may also serve to provide an earth connection between the connector 1 and some housing to which it is attached. A bolt in hole 9 may, in bringing together parts 2 and 3 (for example), force the conductors 5 and 6 into electrical contact with each other or either or both of them into contact with some contact such as an insulation displacement connector (IDC) within the modular connector. One or more of parts 2, 3 and 4 is preferably moulded from a plastics material, such as that known by the Trade Mark, Valox.

In FIGS. 2A and 2B a slightly different design is shown, namely one in which part 4 is moved away from part 3 (initially at least) by translational, rather than pivoting, motion. It is slid along member 10. When it has been separated from part 3 it can, if desired, be rotated as shown to allow better access to the upper face of part 3.

The upper face of part 3 can be seen to show four holes 11. In one embodiment each of conductors 5, 6 (only one of each being shown in these figures) is connected to a respective contact, such as an IDC, within parts 2 and/or 3. Interconnection between conductors 5 and 6 may then be made in part 4, by means for example of interconnection bars that bridge pairs of holes 11. In this way connection between the main conductors 5 and drop wires 6 is made when part 4 is removed. Thus, with the part removed line testing can be carried out independently towards the central office and towards the subscriber. Such testing is represented in FIG. 2A by the meters and arrows directed at holes 11. A bolt 12 is shown in hole 9.

Figure 3A:
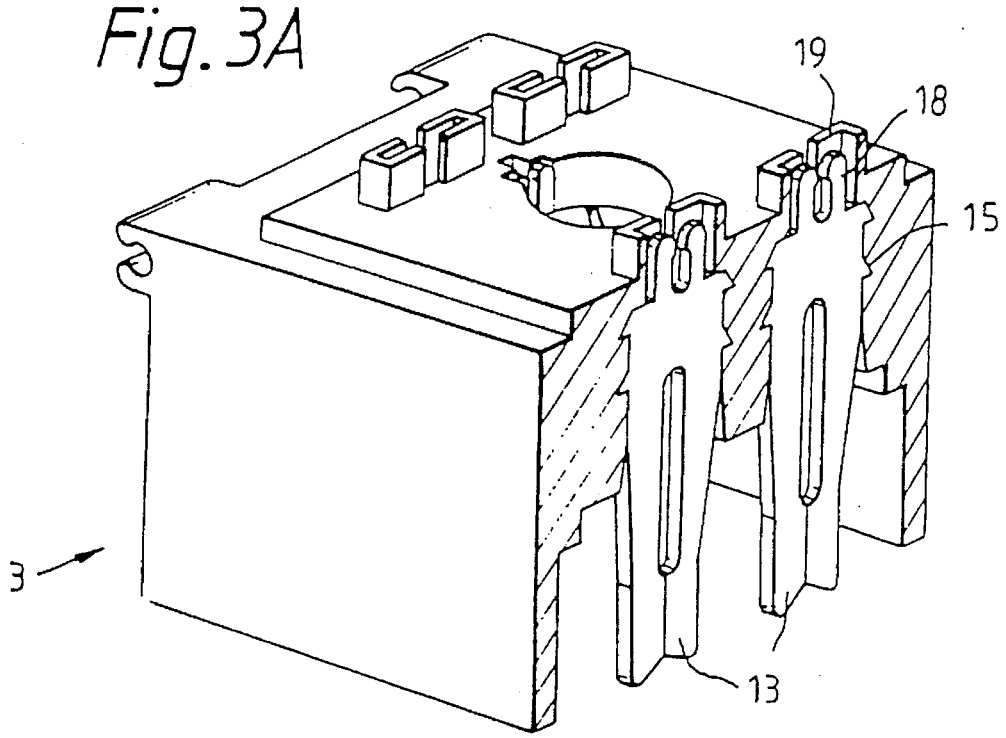
FIGS. 3A and 3B show internal details of a part of a modular connector before use.
Figure 3B:
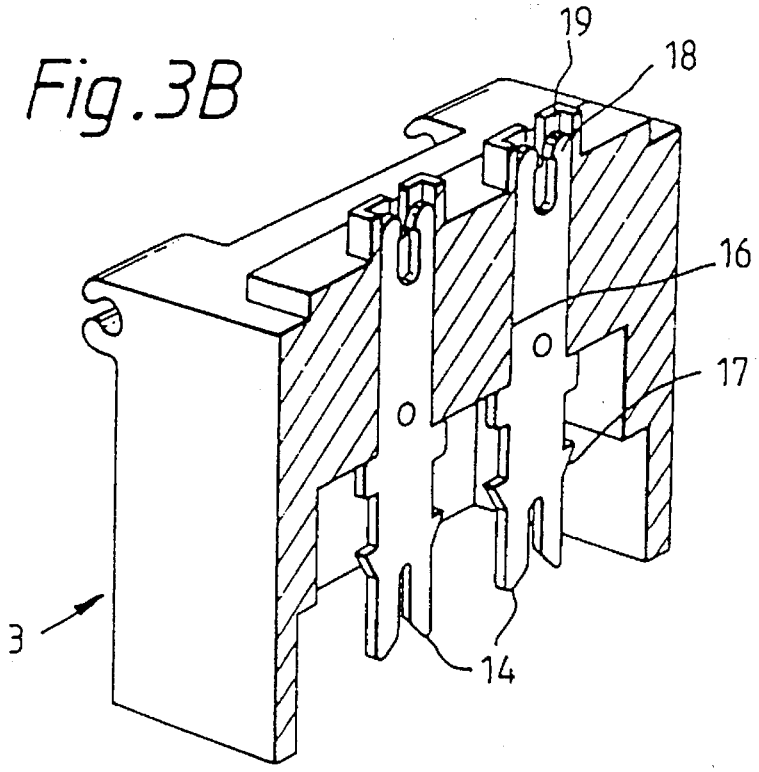

Sections through a part 3 of the modular connector are shown in FIGS. 3A and 3B. The section of FIG. 3A exposing IDCs 13 that make connection to the drop wires, and the section of FIG. 3B exposing IDCs 14 that make connection to the main wires to the central office.

The IDCs 13 can be seen to be locked into part 3 (see FIG. 3A) by means 15 such as interlocking detents, barbs or interference fit. IDCs 14, however, are temporarily secured in part 3 in a way that allows their removal. This may be due to the IDCs and the slots within which they lie having straight parallel sides 16.

Nonetheless IDCs 14 may be provided with detents or other means 17 which lock them into part 2 of the modular connector when parts 2 and 3 are brought together.

Parts 2 and 3 will be brought together with the main and drop wires 5, 6 in position in the modular connector 1. This will cause the wires to be driven into the IDCs 13, 14. As a result electrical connection is made between the IDC and the conductor by cutting through any insulation on the conductor. It can be seen that if parts 2 and 3 are subsequently separated the connection between IDCs 13 and the drop wires 6 will be broken because those IDCs are retracted along with part 3 due to the detents 14. Connection between IDCs 14 and the main wires 5 will not, however, be broken since those IDCs are not retracted; instead they remain in part 2 due to detents 17.

The ends of the IDCs opposite from the ends that make connections to the wires may have means such as slots that allow their interconnection. Such means 18 may project above a surface of the part 3 and be protected by or housed in projections or other means 19.

Figure 4A:
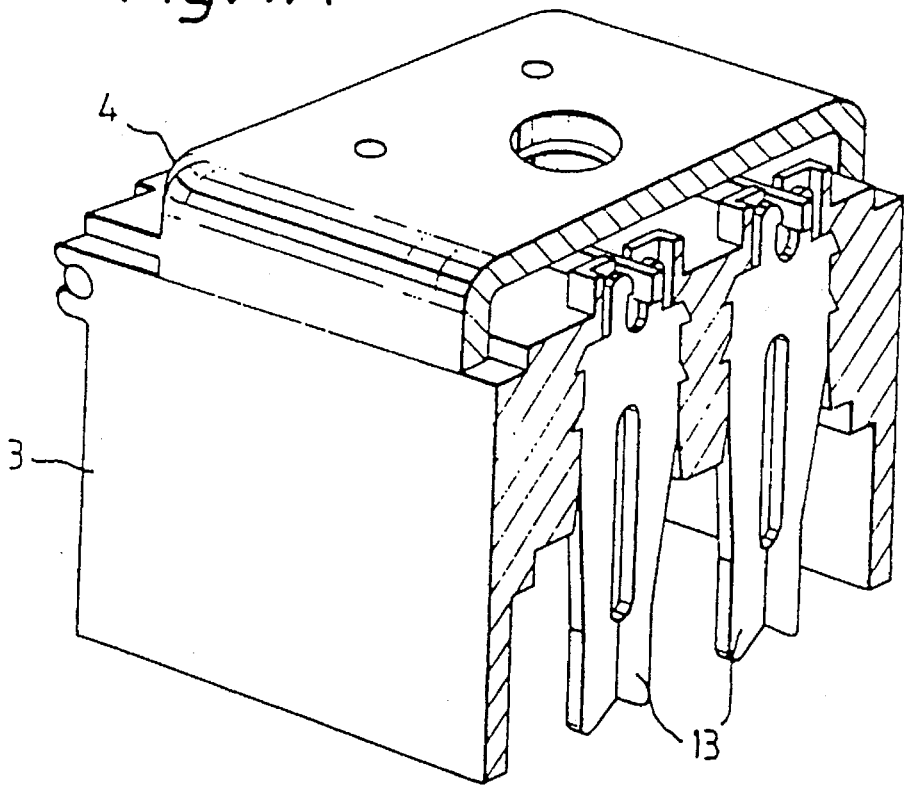
FIGS. 4A and 4B show internal details of a part of a modular connector after use.
Figure 4B:
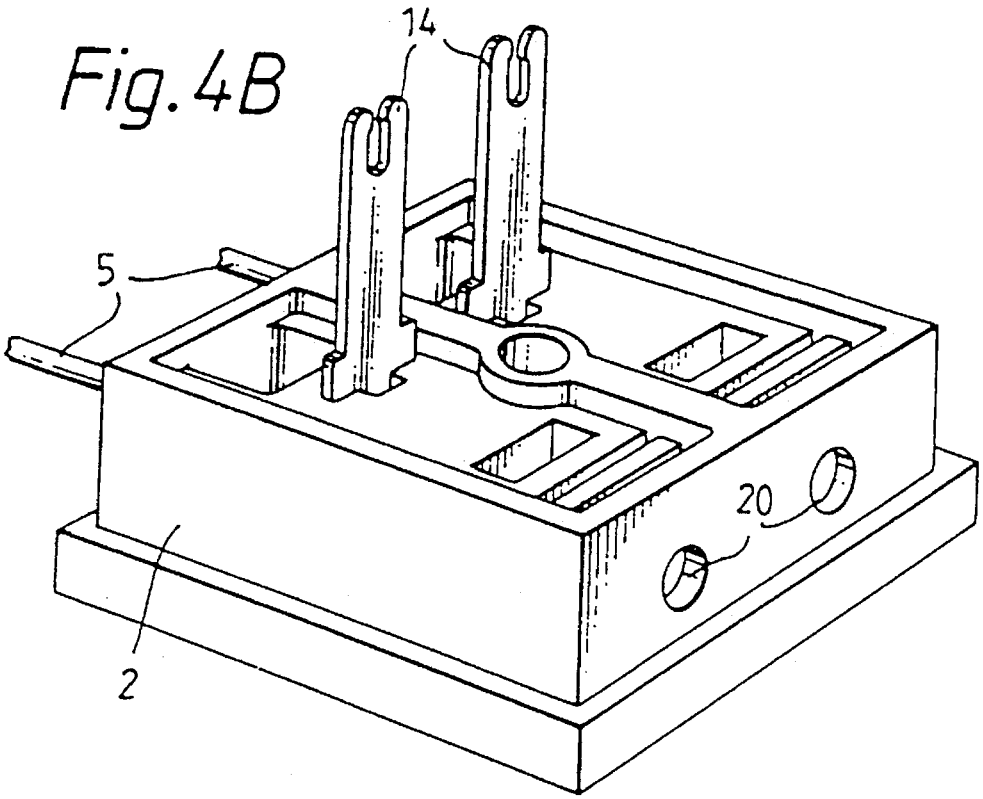

FIGS. 4A and 4B show the result of closing and reopening parts 2 and 3 around main wires 5. FIG. 4B shows the IDCs 14 transferred to the part 2. In the embodiment shown part 2 has significant depth (rather than being a mere base plate) and part 3 telescopes over it and abuts against a peripheral ridge of part 2. Openings 20, preferably closed in cross-section, may be provided in part 2 through which drop wires 6 (not shown in FIG. 4, but see FIG. 1) may pass and by which they may be located. Corresponding openings in part 3 (see FIG. 1) are preferably open in cross-section allowing the telescoping action referred to above over drop wires entering openings 20.

Parts 2 and/or 3 preferably contain a sealing material, such as a gel to provide environmental protection of the various conductors and connectors. As the parts 2 and 3 are telescoped together the enclosed volume will be reduced causing displacement of sealing material around all the parts to be protected, and causing voids to be filled that would otherwise provide leak paths to contaminants such as moisture. The opening through which the wires enter the parts may be reduced as the parts are brought together, thus reducing loss of the sealing material.

Figure 5:
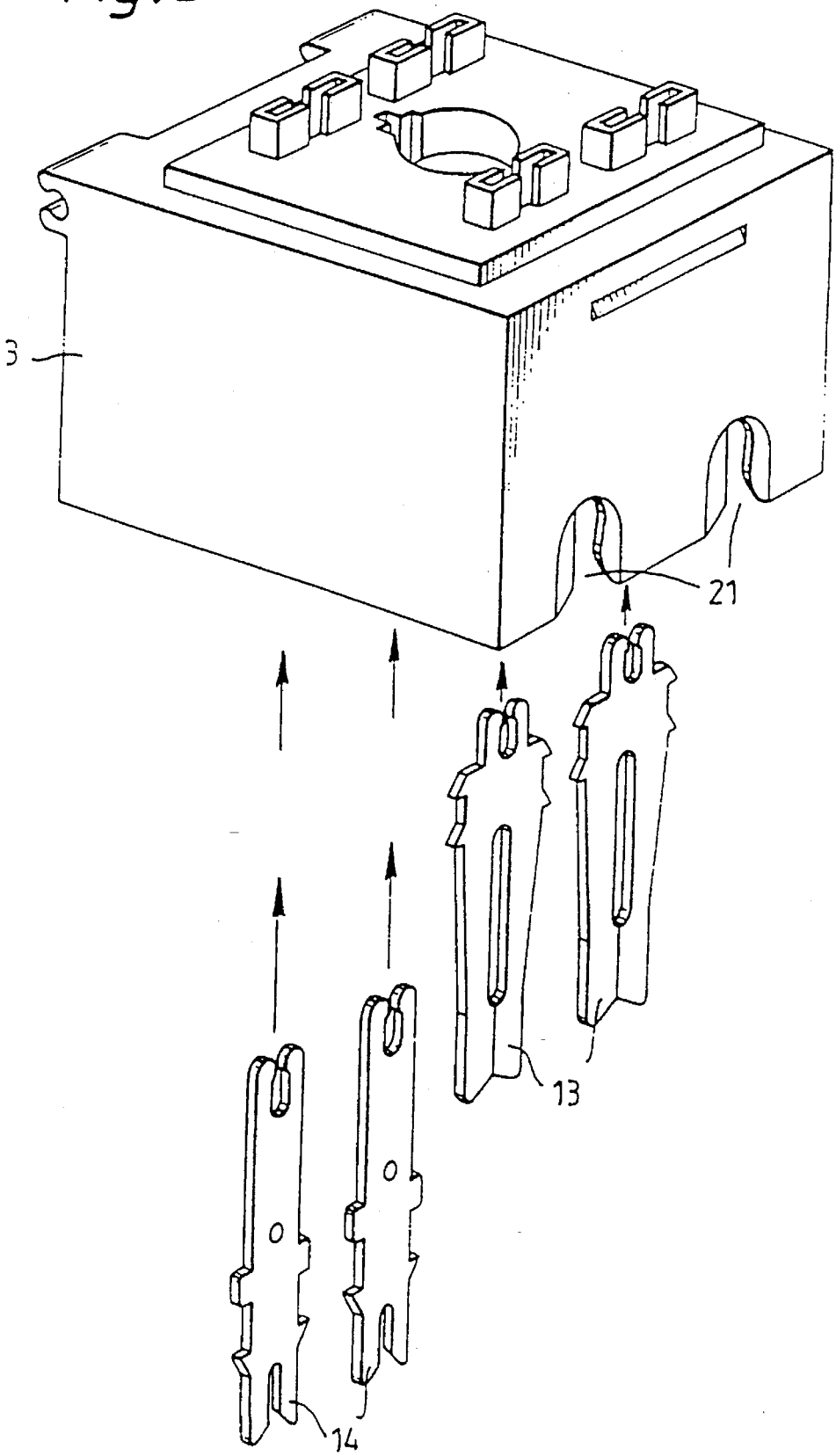
FIG. 5 shows insertion of wire connectors into a part of a modular connector.

FIG. 5 is a further view of part 3 and of the IDCs 13 and 14. A hole 21, open in cross-section, is provided allowing part 3 to telescope with respect to part 2 without disturbing a drop wire carried by it.

Figure 6:
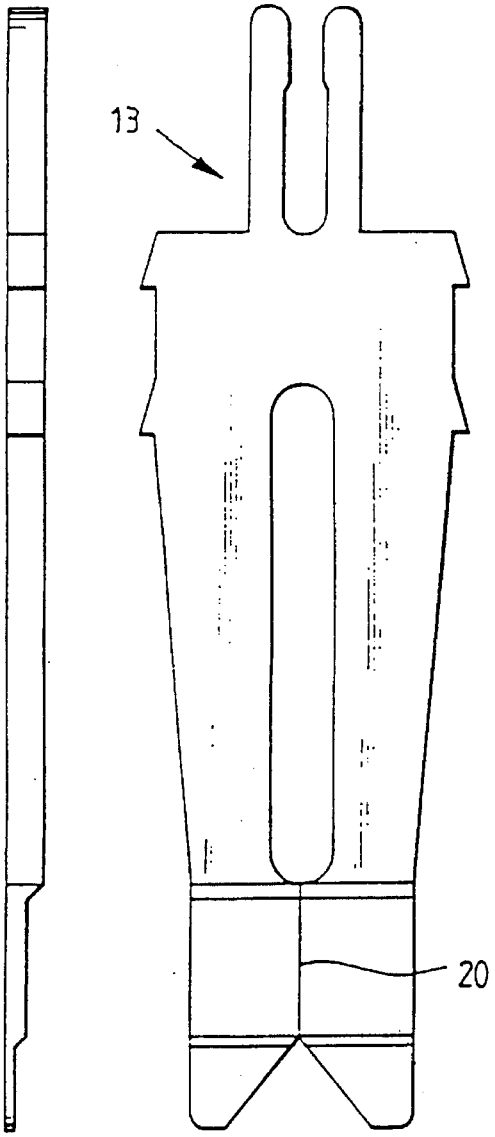
FIGS. 6 and 7 show preferred designs of insulation displacement connectors for use with the modular connector.
Figure 7:
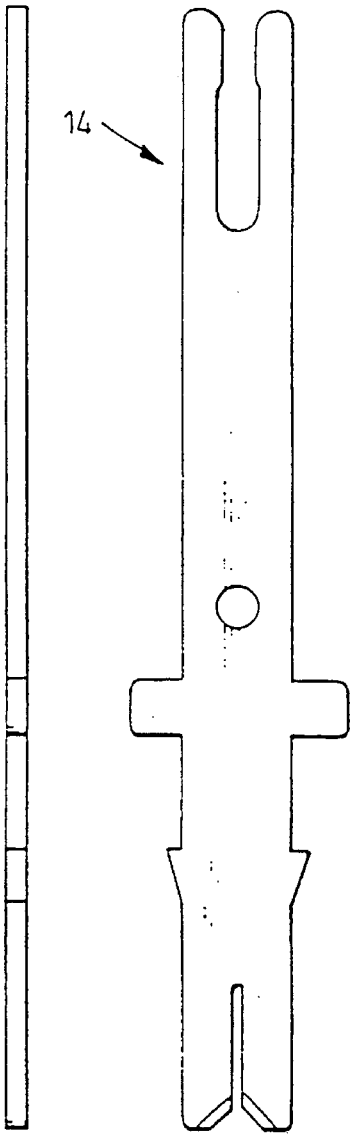

The IDCs 13 and 14 are shown in more detail in FIGS. 6 and 7 respectively. Each figure shows an edge view and a plan view. Preferred dimensions are given in millimeters, and the dimensions given may be varied by ±20%, preferably ±10%, more preferably ±5%. IDC 13 for the drop wire is preferably of zero-gap design as can be seen at 22. The IDCs are preferably of split-beam design, and are preferably substantially planar.

Figure 8:
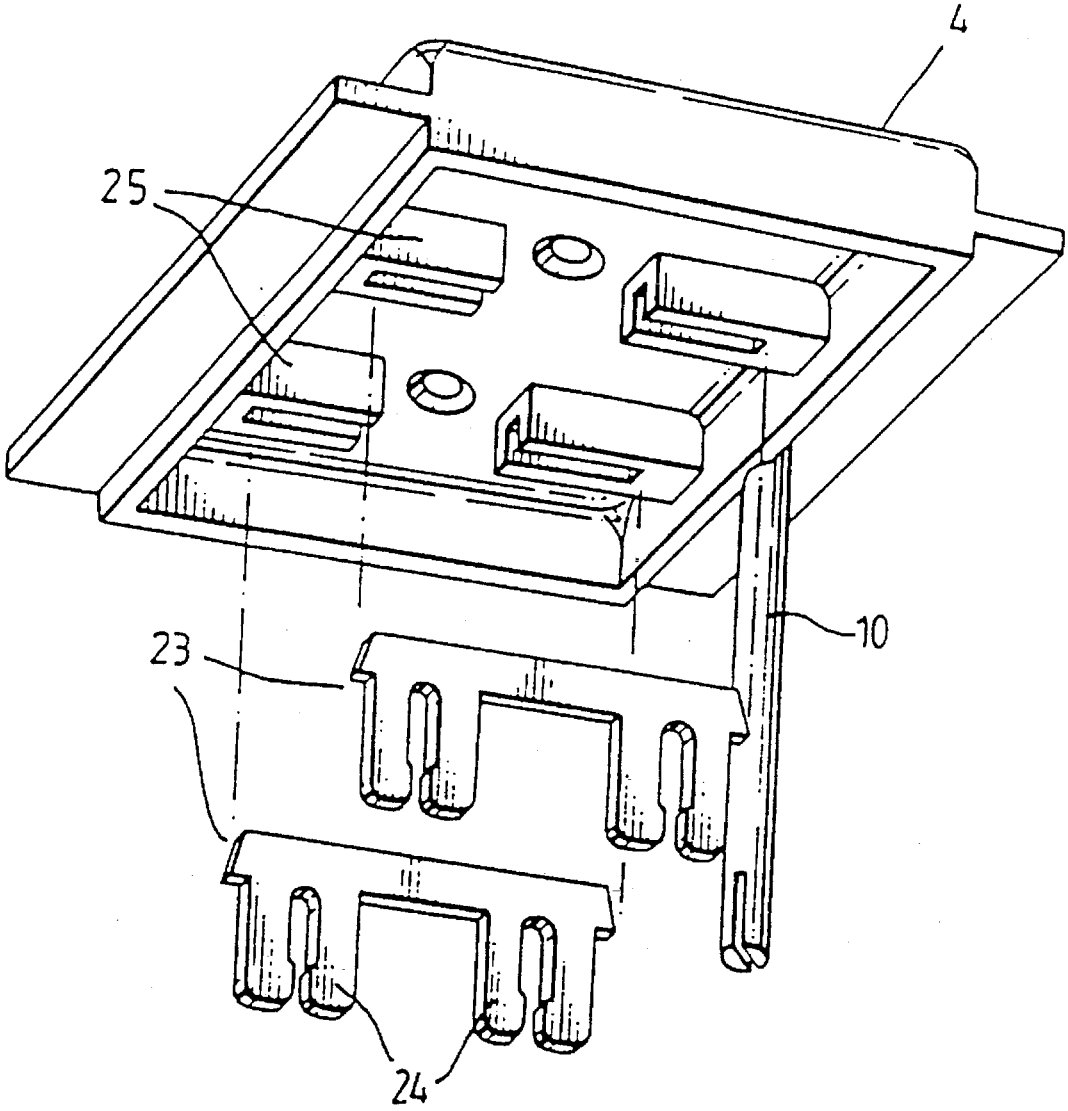
FIG. 8 shows a top part of a modular connector.

FIG. 8 shows one embodiment of part 4. The part 4 has connector bars or other means 23, each of which interconnects an IDC in contact with a main wire and an IDC in contact with a drop wire. The connector bars may have a slotted portion or other means 24 for engaging and making electrical connection to an IDC. Portion 24 may for example engage a slot 18 of an IDC as illustrated in FIG. 3B. The connector bars 23 may be fixed, for example by interference fit, in recesses in mouldings 25.

Figure 9:
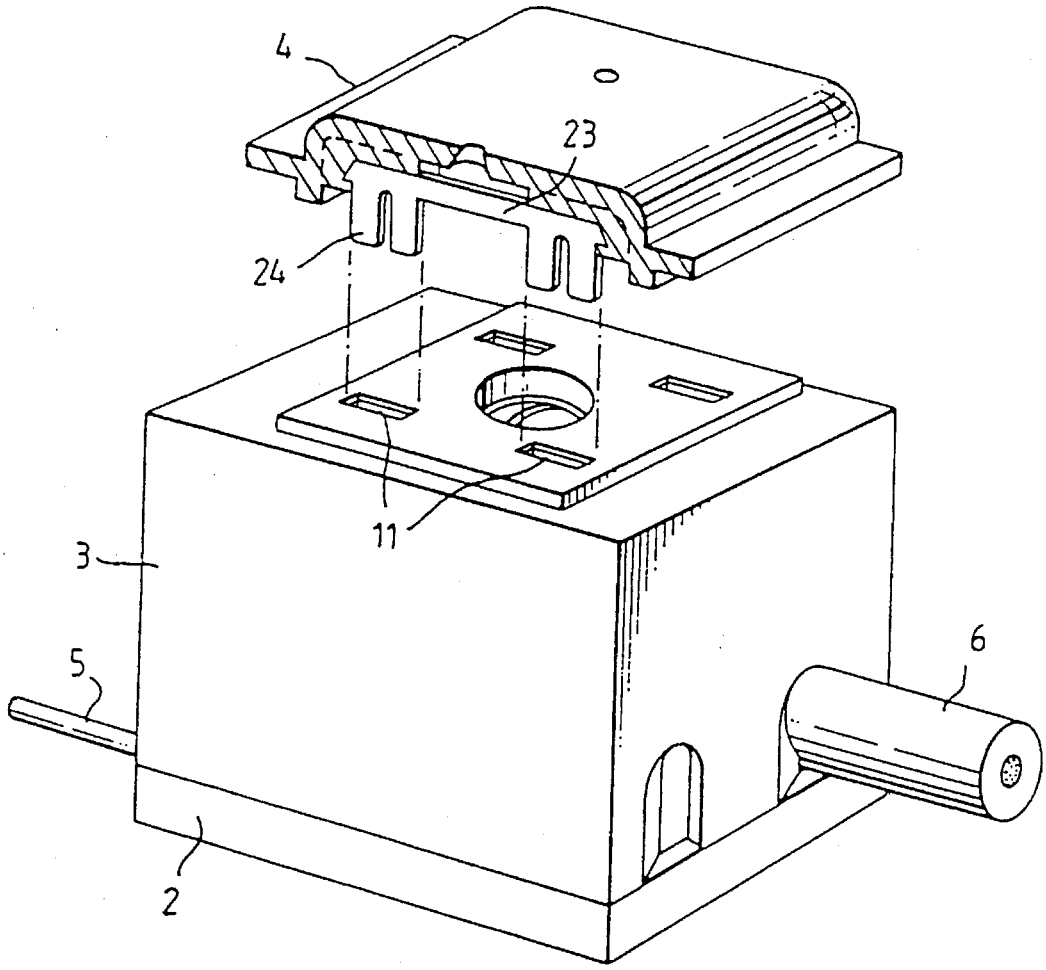
FIG. 9 shows use of a top part with the remainder of a modular connector.

In FIG. 9 the slotted portions 24 of connector bar 23 passes through holes 11 in an upper face of part 3 to engage IDCs within.

Figure 10A:
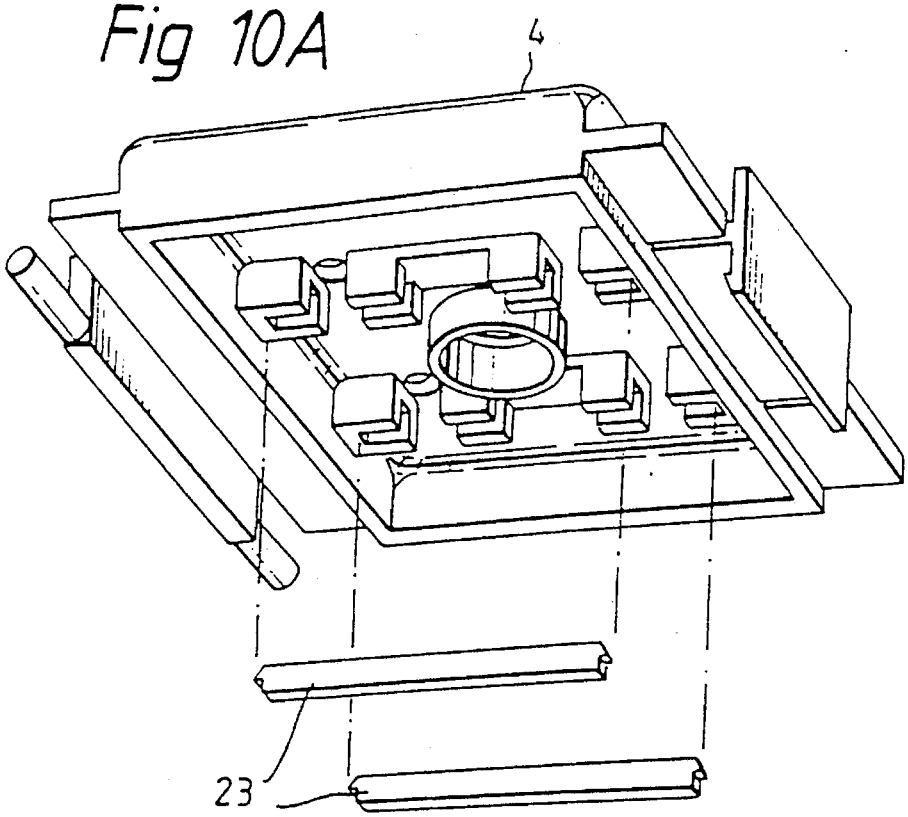
FIGS. 10A, 10B and 11 show use of alternative designs of a top part of a modular connector.
Figure 10B:
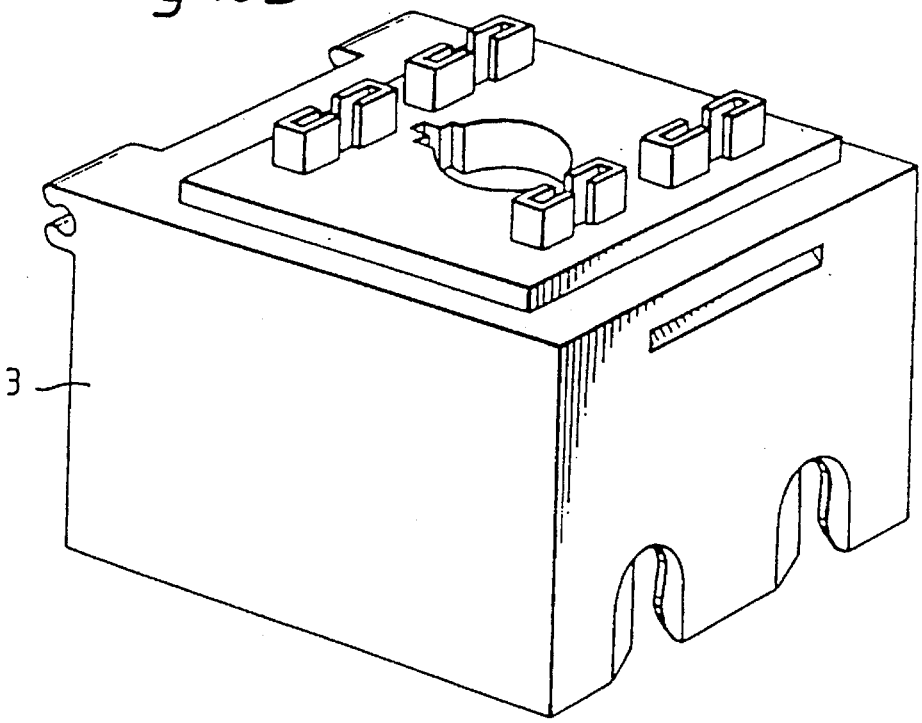

In FIG. 10 the connector bars 23 do not have protruding portions such as the portions 24 of FIG. 9. Here the bars 23 engage IDCs that protrude above the upper surface of part 3.

Figure 11:
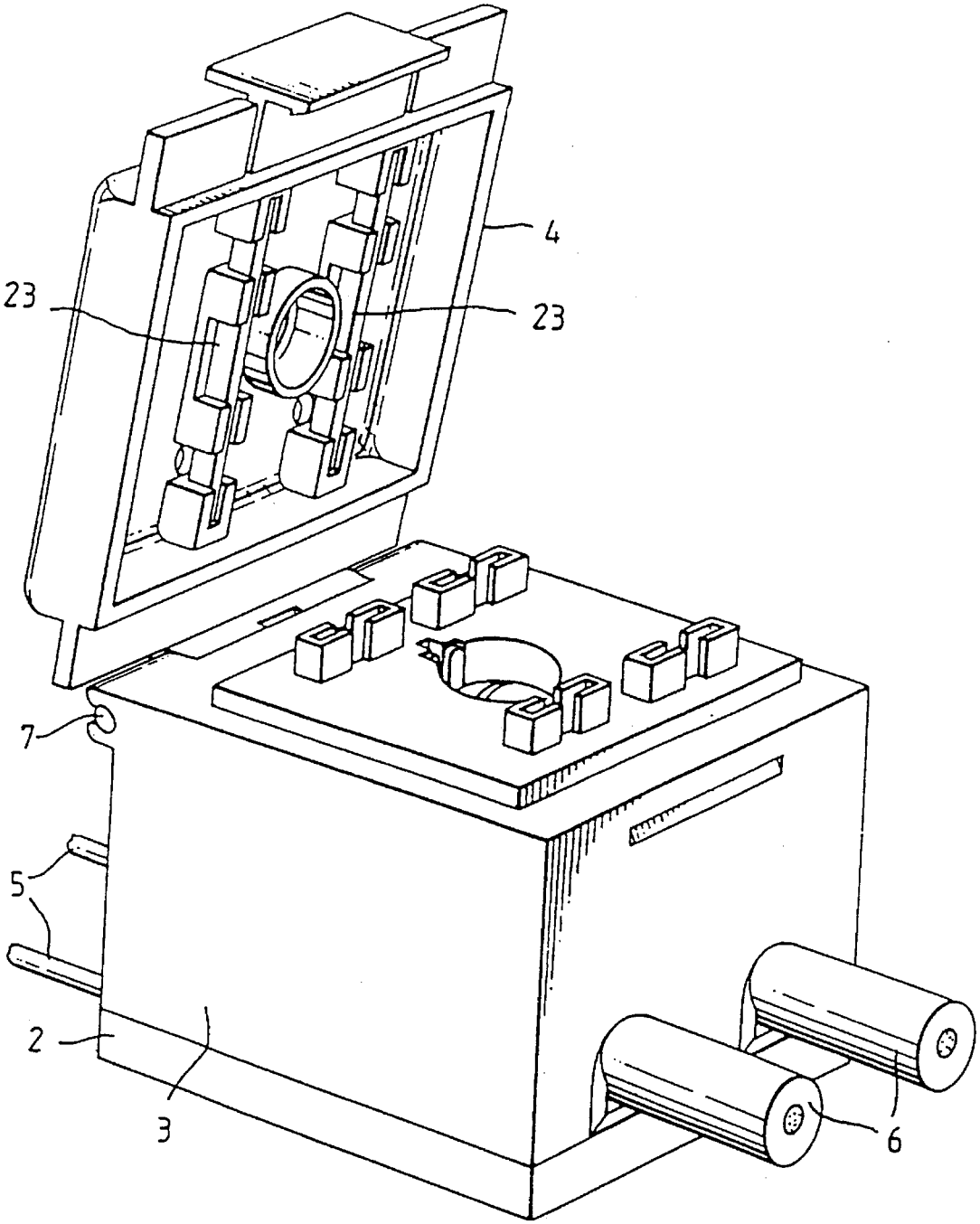
Figure 13A:
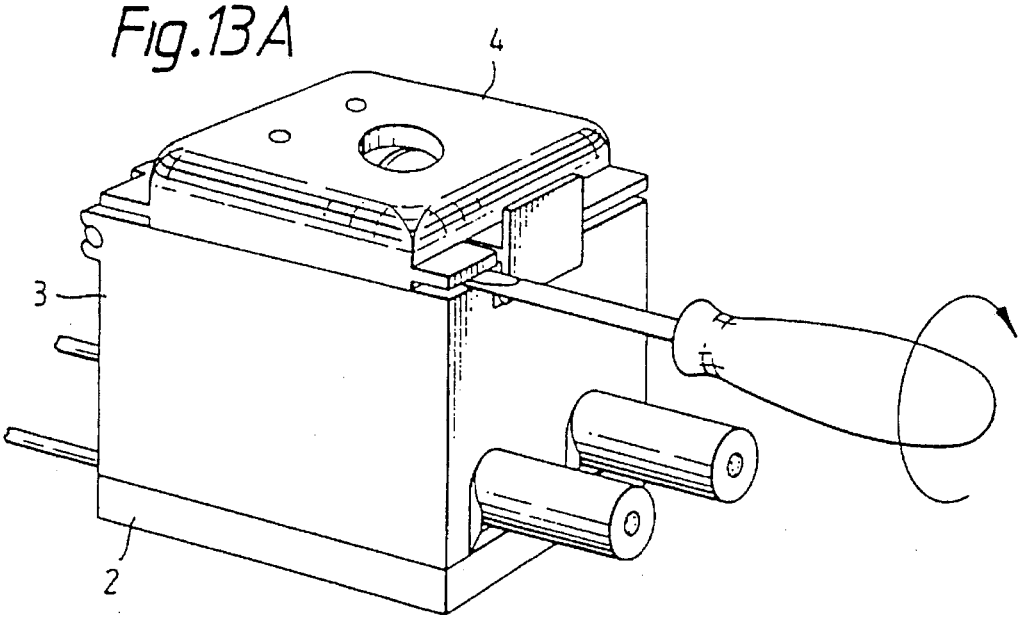
Figure 13B:
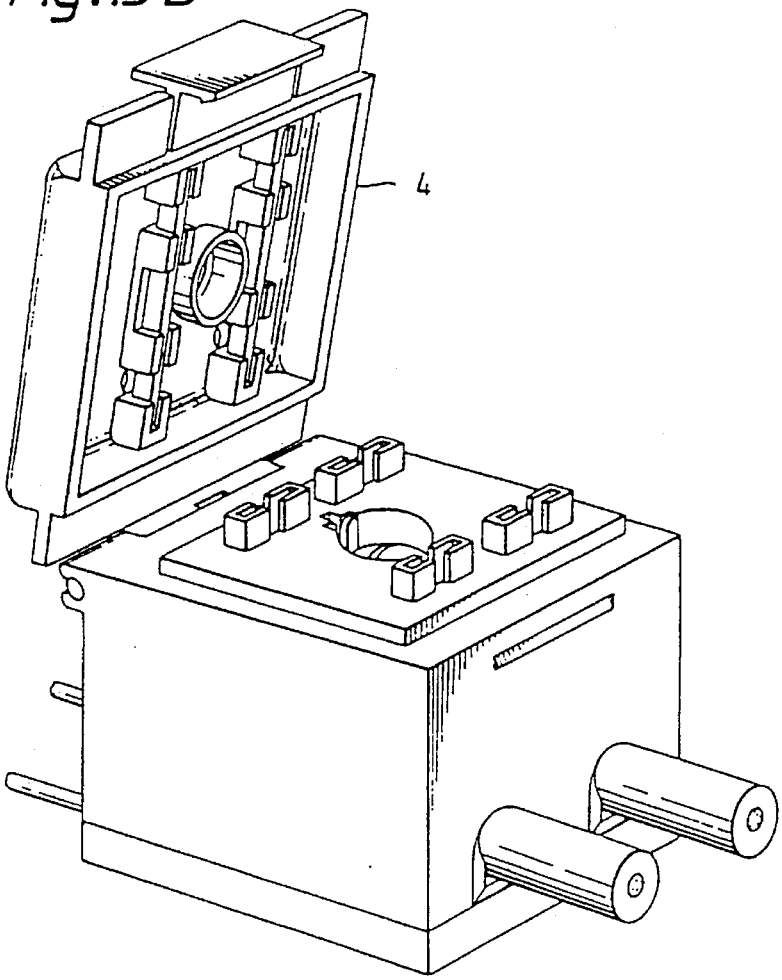
Figure 13C:
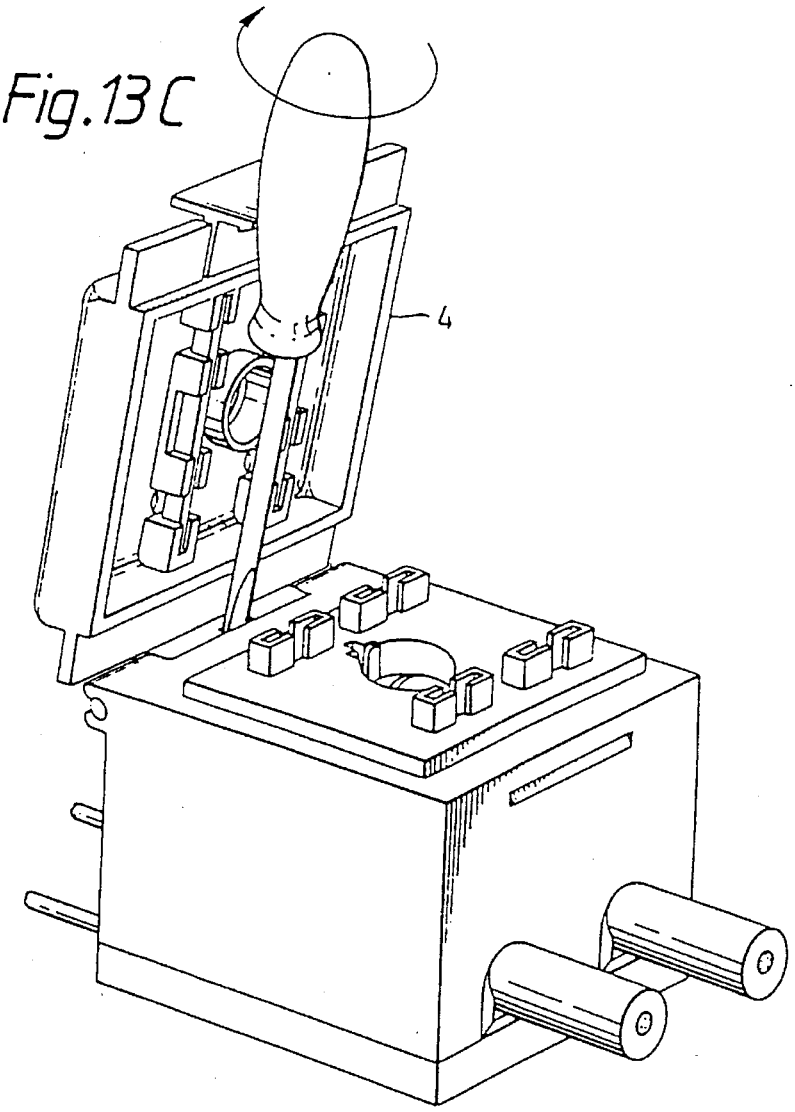
Figure 13D:
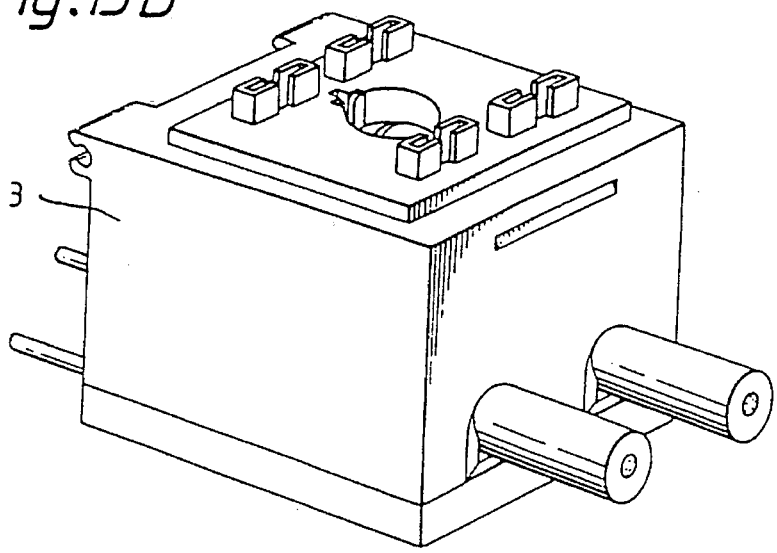

FIG. 11 shows parts 3 and 4 of FIG. 10, hinged together by means of a hinge 7.

FIGS. 12A, 12B and 12C show how the modular connector 1 can incorporate electrical protection. Such protection may provide protection to equipment connected by the connector against over-currents and/or over voltages. It may cause a line to be broken and/or shunt currents to earth. Various protection devices may be used depending on the response time required and the excess voltages and currents likely to be met. Protection may be obtained from solid state switching circuits, conductive polymer devices and/or gas discharge tubes etc.

FIG. 12A shows how so-called 3-pin protection may be achieved. Such protection can short either line (5A,6A or 5B,6B) to earth but cannot break either of the lines. Thus mains cross or lightening surges can be dealt with by sending the power to earth.

The contacts within the projections 19 are interconnected by connection bars 23 as explained above. The part 4, however, contains a protection device that, in the event of an over-voltage will form a connection between the appropriate bar 23 and earthing means 26. When part 4 is closed over part 3, this earthing means 26 contacts some conductor 27, which may be associated with or comprise bolt 12 and which is connected to earth.

In FIG. 12B so-called 5-pin protection is provided in part 4. Here a protection device under normal conditions provides interconnection between contacts 28A and 28B and also between contacts 29A and 29B, thus interconnecting conductors 5A and 5B as well as 6A and 6B when the part 4 is closed over part 3. Under normal conditions no connection is made between any of contacts 28A, 28B, 29A and 29B on the one hand and earthing means 26 on the other. An electrical fault causes either a break between 28A and 29B and/or 29A/29B, or connection of each of those pairs to the earthing means 26, or both.

FIG. 12C shows the connector module with the part 4 closed over part 3.

The invention allows different parts 4 to be used as required. For example, a simple cover that merely provides interconnection could be used, or the 3-pin protection of FIG. 12A or the 5-pin protection of FIG. 12B.

Other parts 4 could be provided. Examples include those providing remote test and/or disconnect facilities or those allowing interconnection of other components. The top face (as drawn) of part 3 may therefore be regarded as a flexibility point allowing access, preferably independently to conductors to the central office and to the subscriber without the need to disturb any IDC or other connections made to the wires themselves.

FIGS. 13A, 13B, 13C and 13D show one example of a series of operations that can be performed to remove a pan 4 prior to replacing it with one having a different function.

Figure 14:
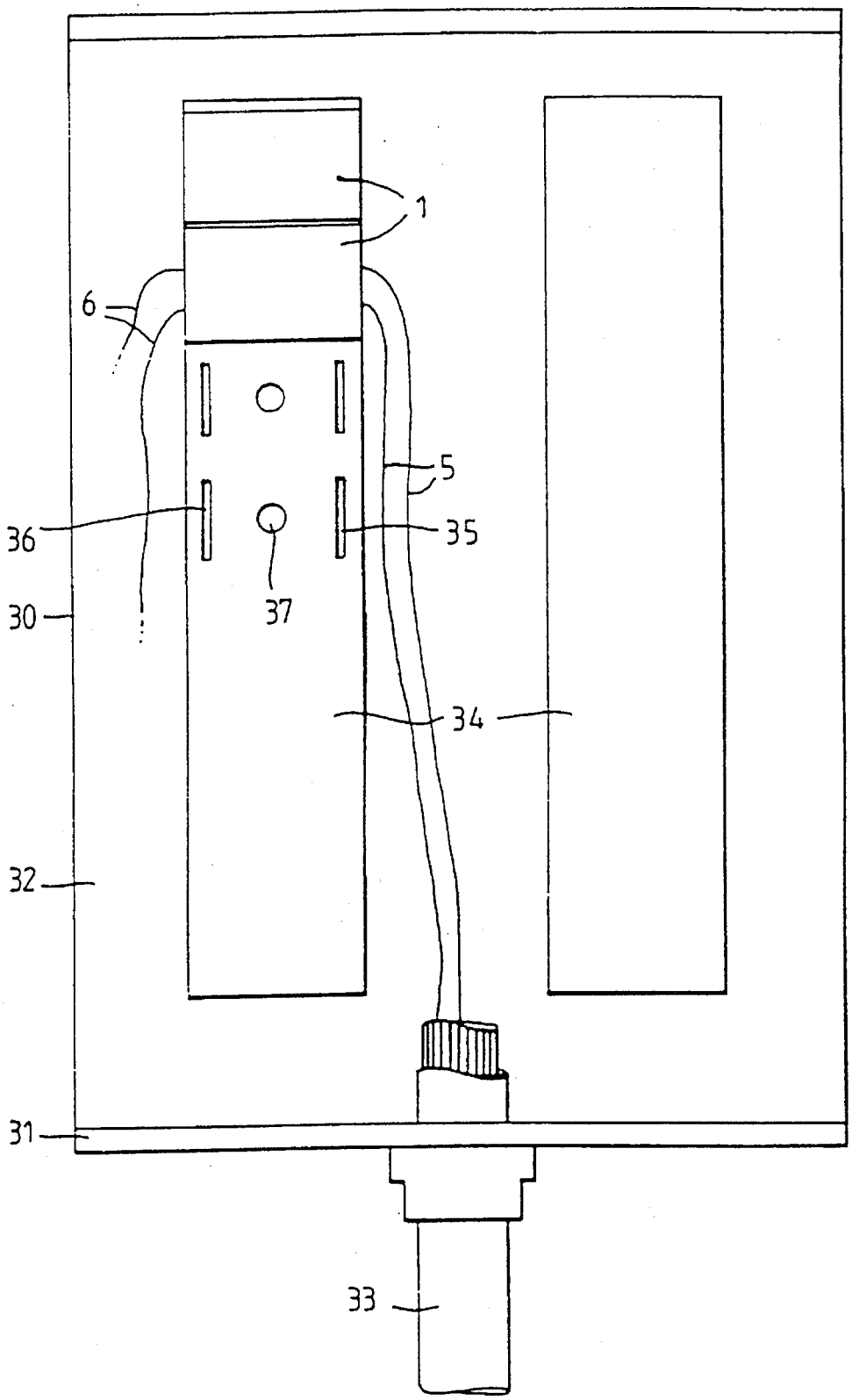
FIG. 14 shows a telecommunications distribution point enclosing modular connectors.

FIG. 14 shows an enclose 30 suitable for use at a telecommunications distribution point. Such an enclosure may be provided at any suitable physical location, such as in a pedestal, in a cabinet, on a pole or hung from a wire. The enclosure 30 comprises a base 31 and a back plate 32. A cover (not shown) may be provided, and the cover or the back plate 32 may carry side walls. An incoming distribution cable 33 passes through and is secured to the base 31. Its conductors 5 (one pair only of which is shown) pass into modular connectors 1 (two of which are shown). The connectors 1 serve, as explained above, to connect such conductors 5 to drop wires 6 which then pass out of the enclosure in any suitable way for example through holes in its base.

The modular connectors 1 may be positioned on a mounting and/or earthing strip or other means 34. Preferably the connectors 1 are mounted in a way that allows easy removal. For example each strip 34 (there are preferably two of them) may have a series of holes, recesses or slots 35 into each of which projections from part 2 of the connectors 1 (see FIG. 1) may protrude. Such projections may be hooked allowing insertion of the connectors 1 at one rotational orientation thereof followed by pivoting motion to bring the connectors flat against the strips 34 at which orientation they cannot be directly withdrawn from the strips. The parts 2 of the connectors 1 may have further projections that latch into further holes, recesses or slots 36 holding the connectors flat against the strips. Holes 37 in the strips may be for receipt of a bolt 12 (see FIGS. 12A). The bolt may have any of various functions such as further securing the connectors to the strips 34, providing earth connection to the strips, and bringing two or more of the parts 2,3 and 4 together to force conductors 5 and/or 6 into IDCs 13 and/or 14, and/or to displace an internal sealing material as required. We prefer that each connector 1 will provide full environmental protection to the wire interconnections (for example by means of a sealing material within the connectors 1) and that enclosure 30 will not need to provide an environmental barrier.

Due to the modular nature of the connectors 1 and to the way in which they can independently be housed in enclosure 30, it is necessary to install only the number of connectors 1 required at the time. More can be added later. This can reduce initial expenditure since a complete terminal block need not be installed at once.

To summarize it is noted that the embodiments illustrated are merely examples; design variations can be made, and different combinations of the features illustrated may be chosen. For example any of the IDC designs, design of parts 2,3 and/or 4, techniques of interconnection/disconnection, techniques for providing electrical protection or environmental protection, enclosures for the connectors, earthing techniques and/or techniques for joining the various parts together may be chosen. Also, various components of the overall design, in particular each of parts 2, 3 and 4 and the enclosure 30 are independently patentable. It is likely that the enclosure 30 optionally together with some modular connectors 1 will be supplied, allowing kits comprising further connectors 1 to be purchased as and when required.

I claim:

1. A connector for interconnecting first and second electrical conductors, comprising (a) a first part;

(b) a second part; the first and/or second parts forming a housing;

(c) a first contact attached to the first part and capable of making contact with the first conductor; and (d) a second contact temporarily attached to the first part and capable of making contact with the second conductor;

the second part having means for receiving the second contact when the first and second parts are brought together such that the second contact remains thus received on subsequent separation of the first and second parts, and the first and second parts and the first and second contacts being arranged such that when the first and second parts are brought together, the first contact makes electrical contact with the first conductor and the second contact makes electrical contact with the second conductor, and when the first and second parts are subsequently separated, the electrical contact between the first contact and the first conductor is broken and that between the second contact and the second conductor is retained.

2. A connector according to claim 1, having a third part that can provide electrical connections between the first and second contacts.

3. A connector according to claim 1 having substantially planar IDCs.

4. A connector according to claim 1 in which the contacts are elongate and lie substantially parallel to one another.

5. A connector according to claim 1, in which all of the contacts are inserted into the connector or a part thereof substantially from one direction.

6. A connector according to claim 1 having means for connection thereof to an earthing strip.

7. An enclosure for a telecommunications distribution point, having means for connection therein of a plurality of connectors according to claim 1 and at least one such connector.

8. A connector according to claim 1, wherein the second contact comprises an IDC, the IDC being transferred from the first part to the second part when the two parts are brought together and subsequently separated.

9. A connector according to claim 1, having four independent electrical contacts such that when the first and second parts are brought together an electrical connection is made between each contact and a respective conductor, the connector having an externally-accessible surface at which electrical connection can be made to each of the four contacts.

10. A connector according to claim 9, in which the first and second parts can telescope together.

11. A connector according to claim 9, in which each of the four contacts terminates adjacent an opening at said surface.

12. A connector according to claim 11, in which each of the four contacts terminates as a slot, each of two pairs of said slots being capable of receiving an interconnecting member externally of the connector.

13. A connector comprising a first part that has externally-accessible contacts, each of which being individually connectable to respective conductors to be connected by the connector, and an interconnection part for interconnecting the contacts, the interconnection part having means for separating from the first part by translational motion, and subsequently by rotation.

14. A connector according to claim 1, containing a sealing material comprising a gel.

15. A connector according to claim 14, in which the gel has a cone penetration value of 100–350 ($10^{-1}$mm) (ASTM D217–68) and/or an ultimate elongation of at least 200% (ASTM D638–80).

* * * * *